United States Patent [19]

Tanimoto

[11] Patent Number: 4,851,875

[45] Date of Patent: Jul. 25, 1989

[54] IDENTIFICATION AND MONITORING OF IMAGE FORMING PROCESS UNITS

[75] Inventor: Yasufumi Tanimoto, Fujisawa, Japan

[73] Assignee: Kabushiki Kaisha Toshiba, Kanagawa, Japan

[21] Appl. No.: 259,420

[22] Filed: Oct. 19, 1988

Related U.S. Application Data

[63] Continuation of Ser. No. 921,136, Oct. 21, 1986, abandoned.

[30] Foreign Application Priority Data

Oct. 22, 1985 [JP] Japan ..... 60-236798

[51] Int. Cl.[4] ..... G03G 15/00

[52] U.S. Cl. ..... 355/245; 355/211; 355/209; 355/308

[58] Field of Search ..... 355/14 C, 14 CU, 3 SH, 355/3 DR, 14 R, 14 SH, 3 DD; 365/22, 72, 78, 103, 175, 243; 377/15, 55, 56, 110, 111; 340/825.34; 235/435, 441, 492; 307/317 R

[56] References Cited

U.S. PATENT DOCUMENTS

| | | | |
|---|---|---|---|
| 3,713,110 | 1/1973 | Bennett et al. | 307/317 |
| 3,757,305 | 9/1973 | Hedin | 235/492 |
| 3,872,324 | 3/1975 | Nahon | 340/825.94 |
| 3,928,750 | 12/1975 | Wölflugseder | 235/492 |
| 4,161,790 | 7/1979 | Winston | 365/63 |
| 4,185,907 | 1/1980 | Baier et al. | 355/3 R |
| 4,311,377 | 1/1982 | Matteson | 354/217 |
| 4,496,237 | 1/1985 | Schron | 355/14 C |
| 4,530,588 | 6/1985 | Kimura et al. | 355/3 DR |
| 4,551,000 | 11/1985 | Kanemitsu et al. | 355/3 DR |
| 4,572,652 | 2/1986 | Tada et al. | 355/14 C |
| 4,579,443 | 4/1986 | Abuyama et al. | 355/14 R |
| 4,585,327 | 4/1986 | Suzuki | 355/14 CU |
| 4,634,258 | 1/1987 | Tanaka et al. | 355/3 DD X |

FOREIGN PATENT DOCUMENTS

| | | | |
|---|---|---|---|
| 2717269A1 | 11/1978 | Fed. Rep. of Germany . | |
| 3335659A1 | 4/1984 | Fed. Rep. of Germany . | |
| 3417664A1 | 12/1984 | Fed. Rep. of Germany . | |
| 3447504A1 | 7/1985 | Fed. Rep. of Germany . | |
| 144842 | 8/1983 | Japan | 355/14 C |
| 58-1958654 | 11/1983 | Japan . | |

*Primary Examiner*—A. C. Prescott
*Assistant Examiner*—Ed Pipala
*Attorney, Agent, or Firm*—Banner, Birch, McKie & Beckett

[57] ABSTRACT

An image forming apparatus including a main body and a processing unit detachably mounted in the main body. The processing unit includes at least one of an image bearing member and developing device. The number of image forming repetitions of the processing unit are counted by a counter in the main body. When the counted number for the processing unit reaches a reference value representing the effective life of the processing unit, an alarm device actuates to notify the user that the effective life of the processing unit has been reached.

17 Claims, 4 Drawing Sheets

IDENTIFICATION AND MONITORING OF IMAGE FORMING PROCESS UNITS

This application is a continuation of application Ser. No. 921,136, filed Oct. 21, 1986.

FIELD OF THE INVENTION

The present invention relates generally to an image forming apparatus and more particularly to an apparatus in which at least one of a photosensitive body and a developing device is a replaceable processing unit so that the unit can be detachably used in a main apparatus.

BACKGROUND OF THE INVENTION

It is general practice in the field of electrostatic copying apparatus to set effective lives for the photosensitive body and developing device in order to ensure production of good copies. Further, in order to facilitate maintenance, a system has been recently adopted for copying machines in which the photosensitive body and the developing device are replaceable processing units. When the units have reached the end of their respective lives, an expert serviceman can replace them.

In a conventional copying apparatus, the frequency of regular service calls is based on how frequently the apparatus is utilized by an averager user. Therefore, users who make more frequent use of a copying apparatus than average users have no choice but to carry out maintenance themselves since their business operations would be slowed if they waited for a regular call by an expert serviceman. Since the general user has little related technical knowledge or experience, in most cases this maintenance is difficult to carry out.

Similarly, the general procedure for deciding when to replace a photosensitive body is to periodically check a total counter on the apparatus main body and replace the photosensitive body when the number of copies has reached a predetermined value corresponding to the photosensitive body's effective life. However, since the photosensitive body replacement period is much longer than that of the developing service, individuals in a busy office are liable to forget to check this properly. Further, the deterioration of images is not easily noticed, since it progresses only a little each day. As a result, there is a tendency to continue using the photosensitive body well beyond its effective life. Because of this, there is a strong demand for measures to make user maintenance of this type of equipment easier.

Recently, a twin color copying apparatus which can copy selectively with a black color toner and a red color toner has been developed. Either the black developing device containing carrier particles and black color toner or the red developing device containing carrier particles and red color toner is selectively set into the apparatus main body corresponding to the desired color copy. Therefore, it is difficult to accurately count the number of image formations for each color developing device by reference to the counter provided on the apparatus main body. As a result, the effective life of the above carrier particles in each color developing device may come to an end unexpectedly so that the user will not have sufficient time to prepare a new developing device. In such cases, the main apparatus must remain unused until the new device is readied.

SUMMARY OF THE INVENTION

It is an object of the present invention to provide an image forming apparatus in which a replaceable processing unit is provided with an identity indicating means and when it is mounted in the apparatus main body a count means is set so as to count the repetitions of the identified processing unit or the number of image formations carried out by the identified unit.

It is a further object of the present invention to make it possible to accurately indicate the end of the effective life of a replaceable processing unit to thereby keep the apparatus in the best condition for use.

According to one aspect of the present invention, there is provided an image forming apparatus including a main body and a plurality of detachable image processing units each including at least one of an image bearing member and a developing device comprising means for separately accumulating the number of image forming repetitions of each of the plurality of processing units, and means for storing the separate cumulative counts of image forming repetitions corresponding to each processing unit.

Preferably, each processing unit includes identity code indicating means for representing an identity code of the processing unit, and the accumulating means includes detecting means for detecting the identity code, and counting means for counting the number of image forming repetitions of the processing unit having the corresponding identity code.

It is also preferred to include first memory means for storing values representative of the number of image forming repetitions corresponding to the effective life of each processing unit, second memory means for storing the identity code of each processing unit detected by the detecting means, and comparing means for comparing the number of image forming repetitions of each processing unit stored in the storing means with the corresponding value stored in the first memory means.

It is also preferred that the comparing means includes means for generating a coincidence signal when the number of image forming repetitions of a processing unit in the apparatus equals the corresponding stored value in the first memory means.

The apparatus also includes alarm means operatively connected to the comparing means and responsive to the coincidence signal for indicating when the processing unit in the apparatus has reached the number of image forming repetitions corresponding to the effective life of the processing unit.

BRIEF DESCRIPTION OF THE DRAWINGS

FIG. 7 is a flow chart showing the flow of operation when the present invention is applied to the developing device.

FIG. 8 is a flow chart showing the flow of operation when the present invention is applied to the photosensitive drum.

DETAILED DESCRIPTION OF THE PREFERRED EMBODIMENTS

The preferred embodiments of the present invention will be described with reference to the accompanying drawings.

Figure 1:
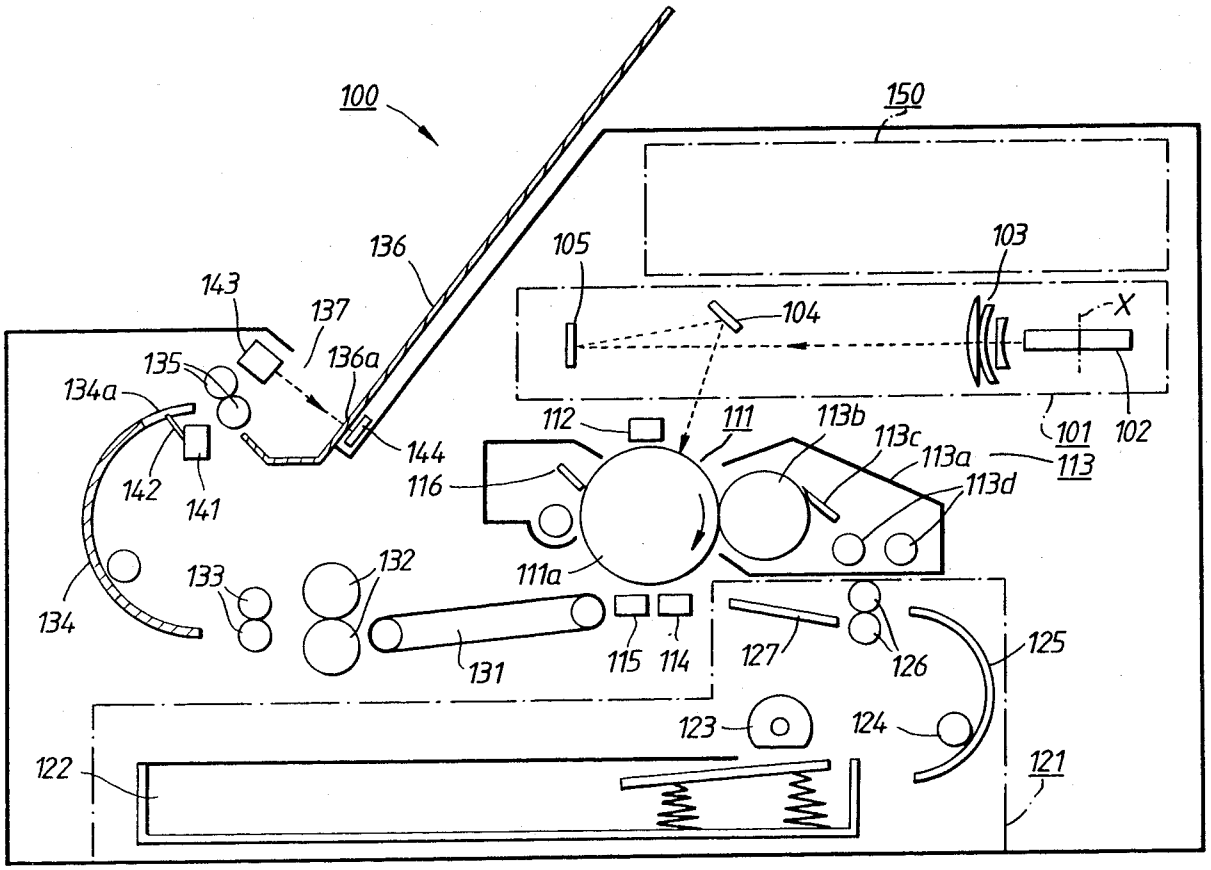
FIG. 1 is a schematic sectional view of the main part of a laser printer to which the present invention is related.

FIG. 1 is a schematic sectional view of the main body 100 of a laser printer according to the present invention. An optical system 101 is provided in main body 100. Optical system 101 includes a polygon mirror 102, a lens group 103 and a set of reflecting mirrors 104 and 105. Polygon mirror 102 is rotatable about the X axis by a suitable means, and light from a laser light source (not shown), which is provided in a position that is vertical with respect to a paper plane, is directed by polygon mirror 102 onto lens group 103.

A photosensitive drum unit 111, constructed as a cartridge, is replaceable mounted in main body 100. A main charger 112, a cartridge unit type developing device 113, a transfer charger 114, a separation charger 115 and a cleaning blade 116 are arranged around a photosensitive drum 111*a* rotatable in the direction of the arrow. Developing device unit 113 comprises known structural elements such as a casing 113*a*, a magnetic roller 113*b*, a developing agent separation blade 113*c* and a stirring auger 113*d*. Casing 113*a* contains a two-component developing agent comprising a mixture of carrier particles and toner powder. Developing device unit 113 is constructed as a cartridge and is replaceably mounted in main body 100.

Figure 2:
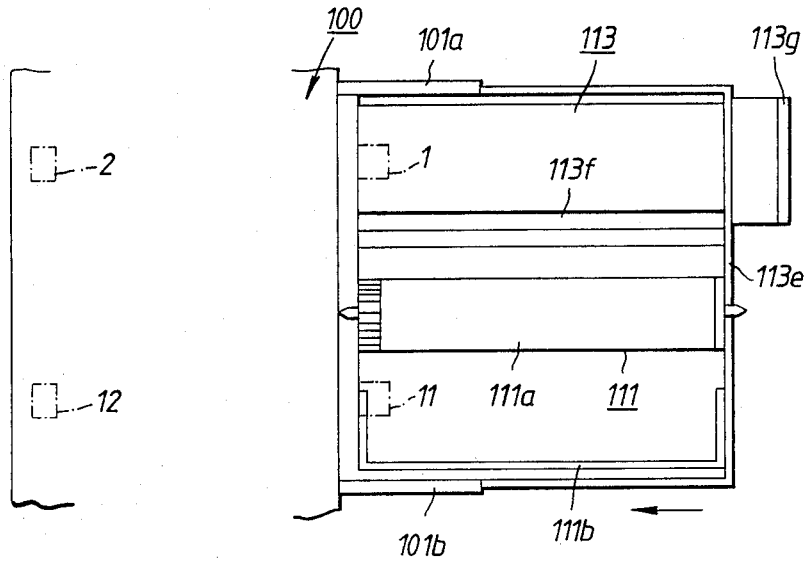
FIG. 2 is a schematic plane view showing a photosensitive drum and a developing device pulled out from the main body of the laser printer.

Referring to FIG. 2, a guide frame 113*e* is slidably supported on a pair of slide rails 101*a* and 101*b* provided in main body 100. Developing device unit 113 is detachably mounted on guide frame 113*e*. A handle 113*g* is provided at the front end of guide frame 113*e* so that guide frame 113*e* may be slidably pulled out from main body 100. An identity indicator 1 is provided on developing device unit 113 so as to be connected to a detector 2 provided in main body 100. A handle 113*f* is attached to developing device unit 113. Developing device 113 can be detached from guide frame 113*e* by carrying handle 113*f*. Photosensitive drum unit 111 is detachably mounted on guide frame 113*e*. An identity indicator 11 is mounted on photosensitive drum unit 111 so as to be connected to a detector 12 mounted in main body 100. A handle 111*b* is attached to photosensitive drum unit 111. Photosensitive drum unit 111 can be detached from guide frame 113*e* by carrying handle 111*b*.

Returning to FIG. 1, an exchangeable cassette type paper supply section 121 consists of a paper supply cassette 122, a paper supply roller 123, an intermediate transporting roller 124, a first guide plate 125, a pair of aligning rollers 126 and a second guide plate 127. Paper supply roller 123 defines an approximate semicircle, as shown in the drawing, and when it rotates one turn, a leading edge portion of a sheet of cut paper (not shown) stacked in paper supply cassette 122 is supplied to the right as shown in the drawing, the length of this leading edge portion corresponding to the effective circumferential length of roller 123. The sheet of paper is then led via first guide plate 125, intermediate transporting roller 124, aligning rollers 126 and second guide plate 127 to photosensitive drum 111*a*.

Transport belt 131 leads the sheet of paper to a thermal fixing roller 132 in a subsequent stage following toner transfer onto the paper and numeral 133 denotes an intermediate roller by which, following fixing, the sheet of paper is led via a third guide plate 134 and exit rollers 135 to a receiving tray 136. Paper detecting switch 141 detects the passage of copies that are delivered. Paper detecting switch 141 comprises an actuator 142 which projects into a cut-out portion 134*a* formed at the upper end of third guide plate 134. A sheet of paper being delivered pushes down actuator 142 as it passes this location, and the number of sheets delivered is counted based on electrical signals corresponding to the number of times actuator 142 is actuated. A light source 143 and a photodetector 144 constitute a paper delivery detection means that detects whether the sheet of paper is present or not via a detection hole 136*a* formed near the lower edge of receiving tray 136.

Figure 3:
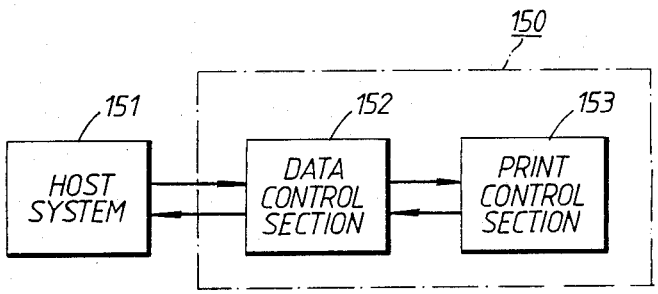
FIG. 3 is a block diagram of the electronic circuit for operation control.

Control circuit device 150 effects control of the printer. As shown in FIG. 3, control circuit device 150 comprises a data control section 152 and a print control section 153. A host system 151 as typified by a computer or word processor is connected to data control section 152 of control circuit device 150. Code data from host system 151 is converted into dot-image data and stored in a page memory (not shown) in data control section 152. This stored dot-image data is output to print control section 153. In print control section 153, a laser beam is modulated in accordance with the input dot-image data from data control section 152 and is directed onto photosensitive drum 111 via optical system 101. This permits subsequent production of a copy by the electrophotographic system.

Figure 4:
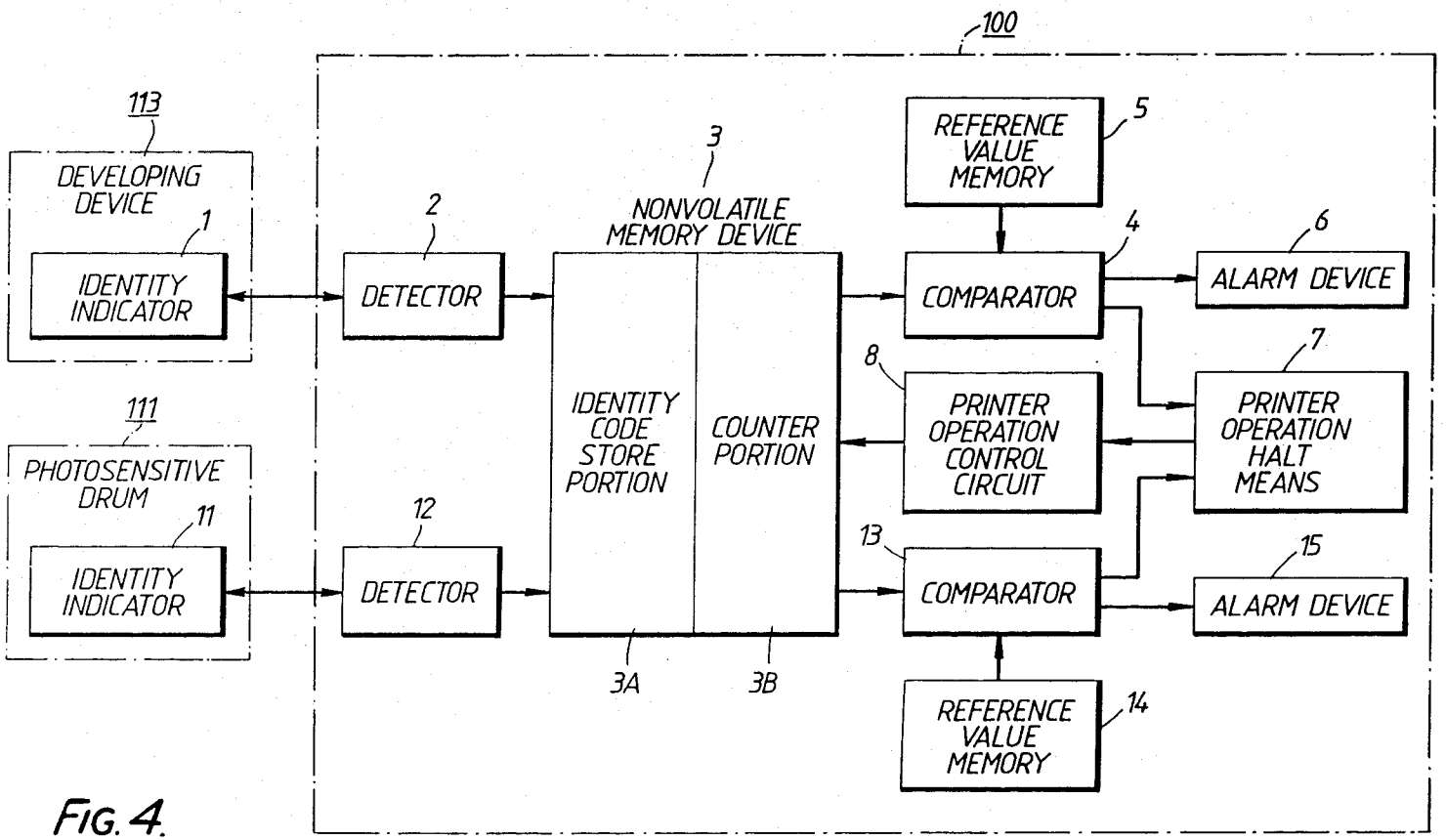
FIG. 4 is a block diagram of the electronic circuit according to the present invention.
Figure 5:
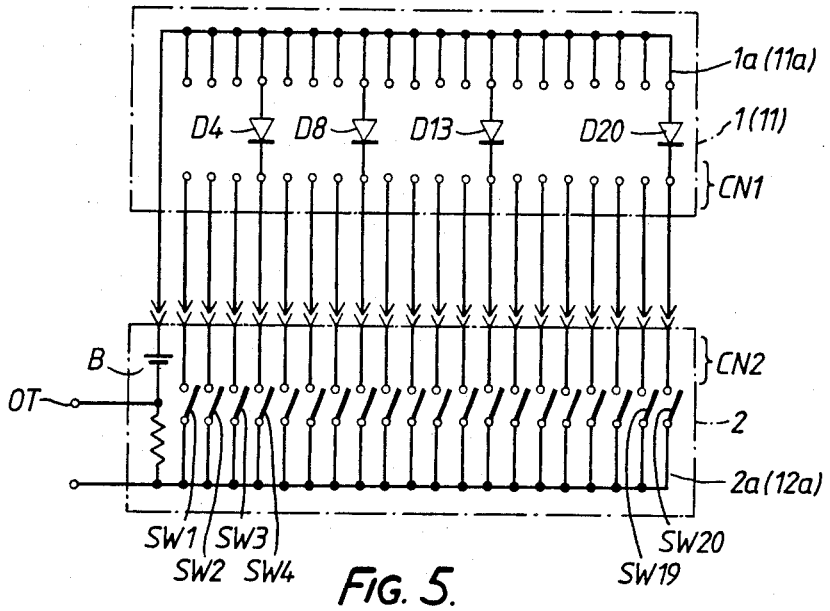
FIG. 5 is a schematic electronic circuit of the identity indicator and the detector shown in FIG. 4.
Figure 6:
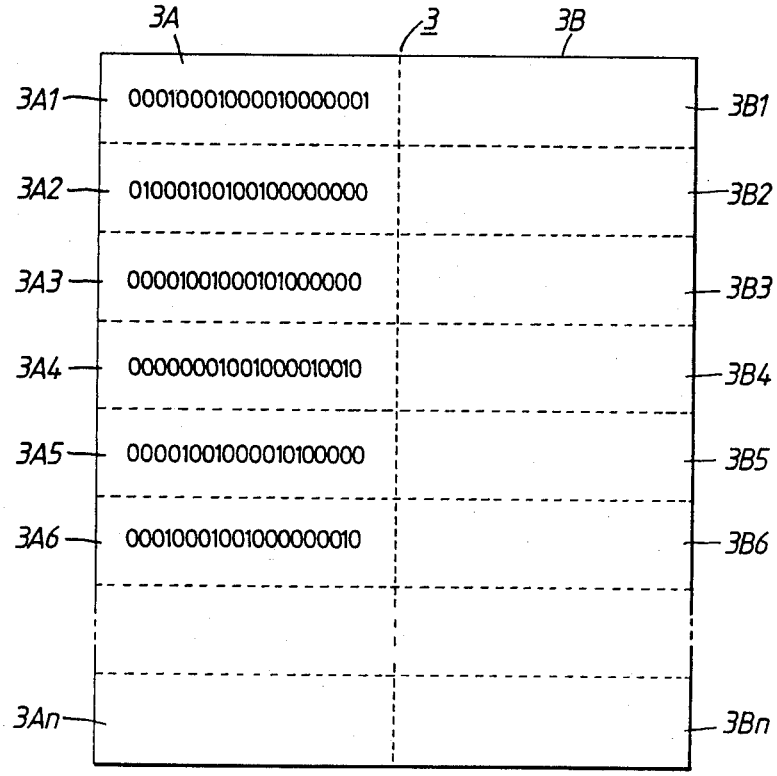
FIG. 6 is a plane view for explaining the memory shown in FIG. 4.

FIG. 4 shows a block diagram of the electronic circuit. Identity indicator 1 is provided on developing device unit 113 as shown in FIG. 2. As shown in FIG. 5, identity indicator 1 comprises a diode circuit 1*a* consisting of four diodes, D4, D8, D13 and D20, of a possible twenty diodes, D1–D20, selectively connected in parallel with each other, and a connector CN1 consisting of twenty terminals connected to detector 2. That is, identity indicator 1 generates 20-bits of code representing an identity of specific developing device unit 113, by selectively connecting several diodes among twenty diodes, D1–D20. The code generated from identity indicator 1, as shown in FIG. 5, which represents the identity of developing device unit 113 is "00010001000010000001". Since all that is needed is to make a distinction between one unit and other units, the identity representing code may be just a manufacturing serial number of the developing device unit, for example. Detector 2 is provided in main body 100 as shown in FIG. 2, and connects to identity indicator 1 when developing device unit 113 is mounted in main body 100. As shown in FIG. 5, detector 2 comprises a switching circuit 2*a* consisting of a group of switching elements SW1–SW20 sequentially actuated, a connector CN2 consisting of twenty terminals connected to connector CN1 of identity indicator 1, a voltage source B and an output terminal OT connected to a nonvolatile memory device 3, shown in FIG. 6. Nonvolatile memory device 3 comprises an identity code storage portion 3A and a counter portion 3B. That is, as shown in FIG. 6, identity code storage portion 3A consists of plural memory area 3A1–3An for storing codes detected by detector 2. Further, counter portion 3B consists of plural shift register 3B1–3Bn for counting print signals output from a printer operation control circuit 8 shown in FIG. 4. Each shift register 3B1–3Bn corresponds to memory area 3A1–3An respectively.

Returning to FIG. 4, a comparator 4 receives counted print signals from counter portion 3B of nonvolatile memory device 3 for comparing the counted print signals with a reference value output from a reference value memory 5. In reference value memory 5, a value "5,000" for example is stored. The value "5,000" represents an effective life of developing device unit 113. Comparator 4 outputs a coincidence signal when the value of counted print signals from counter portion 3B and the reference value from memory 5 are the same. An alarm device 6 receives the coincidence signal from comparator 4 and comprises a display or buzzer, etc. for warning that the effective life of developing device unit 113 has reached its end. When the effective life of the developing device unit expires the carrier particles cannot give enough triboelectric charge to the toner powder since the surface of carrier particles become too smooth after long term use. A printer operation halt means 7 receives the coincidence signal from comparator 4 and supplies a printer operation halt signal to printer operation control circuit 8. Printer operation control circuit 8 outputs print signals and stops the printing operation.

Identity indicator 11 is provided on photosensitive drum unit 111, as shown in FIG. 2. The structure and circuit arrangement of identity indicator 11 is similar to identity indicator 1 provided on developing device unit 113, as shown in FIG. 5. Only the connection of the diodes to the terminals of connector CN1 are different from the arrangement shown in FIG. 5. Identity indicator 11 generates a 20-bit code representing the identity of the specific photosensitive drum unit 111, by selectively connecting several diodes among the twenty diodes D1–D20. As in the case of the developing device unit described above, all that is needed is to distinguish between various units. The identity representing code may be just a manufacturing serial number of the photosensitive drum unit. Detector 12 is provided in main body 100 as shown in FIG. 2, and connects to identity indicator 11 when photosensitive drum unit 111 is mounted in main body 100. Detector 12 defines the same structure and circuit arrangement as described above for the developing device unit. Detector 12 is connected to nonvolatile memory device 3 as described above with relation to the developing device unit. Referring to FIG. 4, a comparator 13 receives counted print signals from counter portion 3B of nonvolatile memory device 3 for comparing the counted printed signals with a reference value output from a reference value memory 14. In reference value memory 14, a value "10,000" for example as a reference value is stored. The value "10,000" represents the effective life of photosensitive drum unit 111 in which photosensitive drum 111*a* is formed of an organic photoconductive material, for example. Comparator 13 outputs a coincidence signal when the value of counted print signals from counter portion 3B and the reference value from memory 14 are the same. An alarm device 15 receives the coincidence signal from comparator 13 and comprises a display of buzzer, etc. for indicating that the effective life of photosensitive drum unit 111 has ended. When the effective life of the photosensitive drum unit ends a poor electrostatic latent image forming operation is performed since the photoconductive material of the photosensitive drum wears out. Printer operation halt means 7 receives the coincidence signal from comparator 13 for supplying a printer operation halt signal to a printer operation control circuit 8. Printer operation control circuit 8 outputs print signals and stops the printing operation, as described above with relation to the developing device unit.

In a factory, when a printer including a replaceable developing device unit and replaceable photosensitive drum unit are manufactured, the effective life of the developing device unit and the photosensitive drum unit, respectively, are pre-set in the main body. Also, the identity code of the developing device unit and the photosensitive drum unit are pre-set. That is, a limited number of printing repetitions that represent the effective life of the developing device unit and the photosensitive drum unit is stored in a reference value memory provided in the main body. An identity code for distinguishing between units is set in an identity indicator of the developing unit and for the photosensitive drum unit.

When an unused developing device unit 113 is mounted in main body 100, as shown in FIG. 2, identity indicator 1 of unit 113 is connected to detector 2 of main body 100. As shown in FIG. 5, detector 2 detects the identity code, e.g., "00010001000010000001" from identity indicator 1. That is, switching elements SW1–SW20 of switching circuit 2*a* sequentially actuate to generate code signals through electric source B and diodes D4, D8, D13 and D20. The code signals are output from output terminal OT of circuit 2*a* and input to nonvolatile memory device 3. In device 3, the identity code "00010001000010000001" corresponding to the code signal input is stored in memory area 3A1 of identity code store portion 3A as shown in FIG. 6, and shift register 3B1 corresponding to memory area 3A1 of memory device 3 is set as a counter. Printer operation control circuit 8 outputs one print signal to shift register 3B1 every time main body 100 performs one printing operation. Shift register 3B1 counts the printing signals output from printer operation control circtui 8, and the counted value is input from shift register 3B1 to comparator 4. Comparator 4 compares the value output from shift register 3B1 and a reference value in memory 5. In reference value memory 5, the value "5,000" as a reference value representing an effective life of developing device unit 113 could have been previously stored, as described above. When the two values output from shift register 3B1 and reference value memory 5 coincide, a coincidence signal is output to alarm device 6 and printer operation halt means 7. As a result, printer operation halt means 7 outputs a printer operation halt signal to control circuit 8, and control circuit 8 stops the printing operation of main body 100. At the same time, alarm device 6 is actuated to notify the user that the printer is inoperative. This alarm actuation indicates that developing device unit 113 is to be replaced immediately, and it is then necessary to replace the developing device unit with a new device unit.

Since the counted value "5,000" is stored in shift register 3B1 of memory device 3, if the developing device unit with which replacement is effected is an old one, the apparatus immediately goes into a state in which replacement is demanded.

When a first developing device unit that is still usable is replaced with a second developing device unit, the number of times that the first developing device unit has been used is stored in the nonvolatile memory device provided in the main body. That is, as shown in FIG. 6, the number of image forming repetitions of the first developing device unit is stored in shift register 3B1 corresponding to memory area 3A1 containing the identity code of the first developing device unit. In a similar manner, the number of image forming repetitions of the second developing device unit is stored in shift register 3B2 corresponding to memory area 3A2 containing the identity code of the second developing device unit. The number of image forming repetitions of each developing device unit has an identity code which is stored in nonvolatile memory device 3. Thus, after a black developing device unit containing black developing agent is placed with a red developing device unit containing red developing agent, used and the black unit is returned again, the black unit effective life can still be accurately monitored.

Although the operation of the developing device unit has been described in the above embodiment, the description about the operation of the photosensitive drum unit is omitted since the operations of the photosensitive drum unit and the developing device unit are almost the same. In developing device unit 113, the reference value stored in reference value memory 5 is "5,000" for example. However, in photosensitive drum unit 111, the reference value stored in reference value memory 14 is "10,000" for example.

In the present invention, a developing device or photosensitive drum is constructed as a replaceable unit, and an identity indicator is provided on this replaceable unit. When the unit is mounted in a printer main body, an identity code signal generated from the identity indicator is automatically set in the printer main body as an identifying signal by which the unit is distinguished from other units.

As described above, the image forming apparatus according to the present invention accurately indicates the end of the effective life of a replaceable processing unit and keeps the apparatus always in the best condition for use.

While the present invention has been particularly shown and described in connection with a laser printer, it is to be understood that the application of the processing unit of the invention is not limited to a laser printer only. As another application of the processing unit of the present invention invention, mention may be made of, for example, copying apparatus of facsimile apparatus. That is, it should be understood that the present invention may variously be changed and modified without departing from the spirit of the invention or the scope of the appended claims.

I claim:

1. An image forming apparatus comprising:

a main body;

at least two types of processing units to be used for image forming operations, said processing units comprising a first unit having a first prescribed effective life and a second unit having a second prescribed effective life different from that of said first unit, both units being detachably mounted in said main body, each of said processing units including an identity indicating means for representing an identity of each of said processing units;

detecting means for detecting the identity of each of said processing units and producing an identity code corresponding to each of said processing units; and storage means associated with each of said processing units for separately storing the number of image forming operations conducted by each of said processing units.

2. The apparatus of claim 1 further comprising control means responsive to the detecting means for simultaneously storing counts of the number of image forming operations conducted by each type of said detachably mounted processing unit in said storage means.

3. The apparatus of claim 1 wherein said identity indication means comprises a manufacturing serial number for uniquely identifying each of said processing unit.

4. The apparatus of claim 1 further comprising at least one mounting unit including a guide frame mounted to said main body for slidable movement between a first position in which said guide frame is in said main body and a second position in which said guide frame is outside of said main body, said two types of processing units being detachably mounted to said guide frame.

5. The apparatus of claim 1 wherein said first type of processing unit comprises a developing device and said second type of processing unit comprises a photosensitive body.

6. The apparatus of claim 5 further comprising at least one mounting unit including a guide frame mounted to said main body for slidable movement between a first position in which said guide frame is in said main body and a second position in which said guide frame is outside of said main body, said developing device and photosensitive body being detachably mounted to said guide frame.

7. The apparatus of claim 1 wherein said storage means includes a plurality of shift registers.

8. The apparatus of claim 7 wherein each of said shift registers corresponds to one memory area for separately storing the number of image forming operations of one of said processing units.

9. The apparatus of claim 1 wherein said identity indicating means includes a first electrical connector comprising plural conductors, and said detecting means includes a second electrical connector comprising plural conductors, said first and second connectors being connected to each other when said processing units are mounted in said main body, said detecting means also includes means for sequentially actuating conductors of said second electrical connector.

10. The apparatus of claim 9 wherein said identity indicating means include a diode circuit connected to said first electrical connector, said diode circuit including plural diodes selectively connected in parallel.

11. The apparatus of claim 10 wherein said actuating means of said detecting means includes a switching circuit connected to said second electrical connector, said switching circuit for sequentially actuating conductors of said second electrical connector and said diode circuit when said first and second electrical connectors are connected to each other.

12. The apparatus of claim 1 further comprising first memory means for storing first values representative of the number of image forming repetitions corresponding to the first prescribed effective life of said first type of processing unit and for storing values representative of the number of image forming repetition corresponding to the second prescribed effective life of said second type of processing unit;

second memory means for storing the identity code of each of said processing units produced by said detecting means; and comparing means for comparing the number of image forming repetitions of each of said processing units stored in said storage means with the corresponding first or second values stored in said first memory means.

13. The apparatus of claim 12 wherein said second memory means includes a nonvolatile memory device.

14. The apparatus of claim 13 wherein said nonvolatile memory device comprises an identity code storage portion including a plurality of memory areas for storing identity codes produced by said detecting means.

15. The apparatus of claim 12 wherein said comparing means include means for generating a coincidence signal when the first or second values representative of the number of image forming repetitions corresponding to the different prescribed effective lives of each type of said processing unit in the apparatus equals the corresponding number stored in said storage means for each processing unit.

16. The apparatus of claim 15 further comprising alarm means operatively connected to said comparing means and responsive to the coincidence signal for indicating when each of said processing units in the apparatus has reached the corresponding value of image forming repetitions corresponding to each of the first and second prescribed effective lives.

17. The apparatus of claim 15 also including halt means responsive to the coincidence signal for preventing further operation of said processing units in the apparatus.

* * * * *